United States Patent [19]

Andreoli

[11] 4,143,873

[45] Mar. 13, 1979

[54] PRACTICE TENNIS RACKET WITH RACKET HEAD INSERT

[76] Inventor: Robert M. Andreoli, 255 Rumstick Point Rd., Barrington, R.I. 02806

[21] Appl. No.: 886,623

[22] Filed: Mar. 13, 1978

[51] Int. Cl.[2] ..... A63B 69/38

[52] U.S. Cl. ..... 273/29 A; 273/73 R

[58] Field of Search ..... 273/29 A, 29 R, 73 R, 273/73 D, 73 L, 73 A, 30

[56] References Cited

U.S. PATENT DOCUMENTS

| | | | |
|---|---|---|---|
| 3,820,785 | 6/1974 | Ocihipinti | 273/73 R |
| 3,843,121 | 10/1974 | Edlefsen | 273/73 L |

*Primary Examiner*—Richard T. Stouffer
*Assistant Examiner*—T. Brown
*Attorney, Agent, or Firm*—Salter & Michaelson

[57] ABSTRACT

A practice game racket having a handle and a peripheral frame attached thereto. The frame is provided with a slidable insert defining an overall practice impact area for a game ball and in turn having a smaller generally centrally disposed second area in the form of an opening therethrough such that the proper execution of the preferred practice stroke will enable the game ball to entirely pass through said opening without impacting the racket and in this way demonstrate the correct execution of a preferred practice stroke in a dramatic manner. A series of inserts may be utilized, each having an opening of decreasing size such that progressive replacement with inserts having smaller openings will enable a player to provide increasingly difficult practice sessions.

10 Claims, 7 Drawing Figures

PRACTICE TENNIS RACKET WITH RACKET HEAD INSERT

BACKGROUND OF THE INVENTION

This invention relates to a practice racket as might be utilized in practicing games such as tennis and the like. The central stringed area of a conventional tennis racket, often referred to as the "sweet spot" is the most desirable area with which to contact the game ball in play. Accordingly, practice with a conventional racket makes it extremely difficult to determine whether or not the ball had been impacted at such most desired central location. In an attempt to remedy this situation, several practice racket constructions have been devised including those shown in the following U.S. Patents: No. 3,503,611 issued Mar. 31, 1970; No. 3,820,785 issued June 28, 1974 and No. 4,032,142 issued June 28, 1977.

Of such prior art constructions, the '611 patent shows a practice racket wherein the strings thereof have been removed from the frame and a cover in turn having a central opening, disposed thereover. This opening communicates with a pouch such that, the ball, if properly "struck", will pass through the central opening and be captured within the pouch. The obvious problem in such a construction is that the practice racket is one-sided, i.e. one would have to shift or keep shifting one's grip on the racket so that the pouch would be disposed to the rear of the opening in both forehand and backhand shots. The '785 patent positions a masking device or cover over the strings on both sides of a conventional tennis racket. The device includes a central opening such that desired contact of the ball with the desired central portion of the racket will apparently be discerned by differences in sound and resultant ball trajectory. The '142 patent utilizes a frame having a net on one side and string means on the other side thereof such that a ball may pass through the string means, but not the net so as to be caught by the racket between the net and string means.

The above citation and discussion of the preceding prior art patents constitutes applicant's Prior Art Disclosure. The constructions represented by such patents, while providing desirable end results do not, however, sufficiently distinguish between the execution of acceptable and preferred practice strokes.

Accordingly, it would be desirable to provide a practice racket which dramatically distinguishes between the execution of poor or average and preferred practice strokes. It is accordingly a primary object of the present invention to provide a practice racket which indeed dramatically demonstrates correct execution of a preferred practice stroke.

A further object of the present invention is the provision of a practice racket which enables the difficulty of a preferred practice stroke to be varied such that increasingly difficult practice sessions may be achieved.

A still further object of the present invention is the provision of a practice racket of the aforementioned type in which minimal constructional modifications are made such that the realistic feel and appearance of an actual game racket is retained during use of such practice racket.

These and other objects of the present invention are achieved by the provision of a practice racket having a handle and a peripheral frame attached thereto. Instead of the conventional string, the frame is provided with at least one insert which in turn defines a practice impact area within the frame adapted to contact the ball upon execution of average or undesirable practice strokes. The insert is in turn provided with a central opening of an extent materially larger than the game ball and corresponding to the size and position of the preferred contact area, i.e. "sweet spot", such that when a player properly executes a preferred practice stroke, the game ball will entirely pass through said opening without touching the racket. In this way then, the absence of the racket touching the ball dramatically illustrates the execution of a preferred practice stroke.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
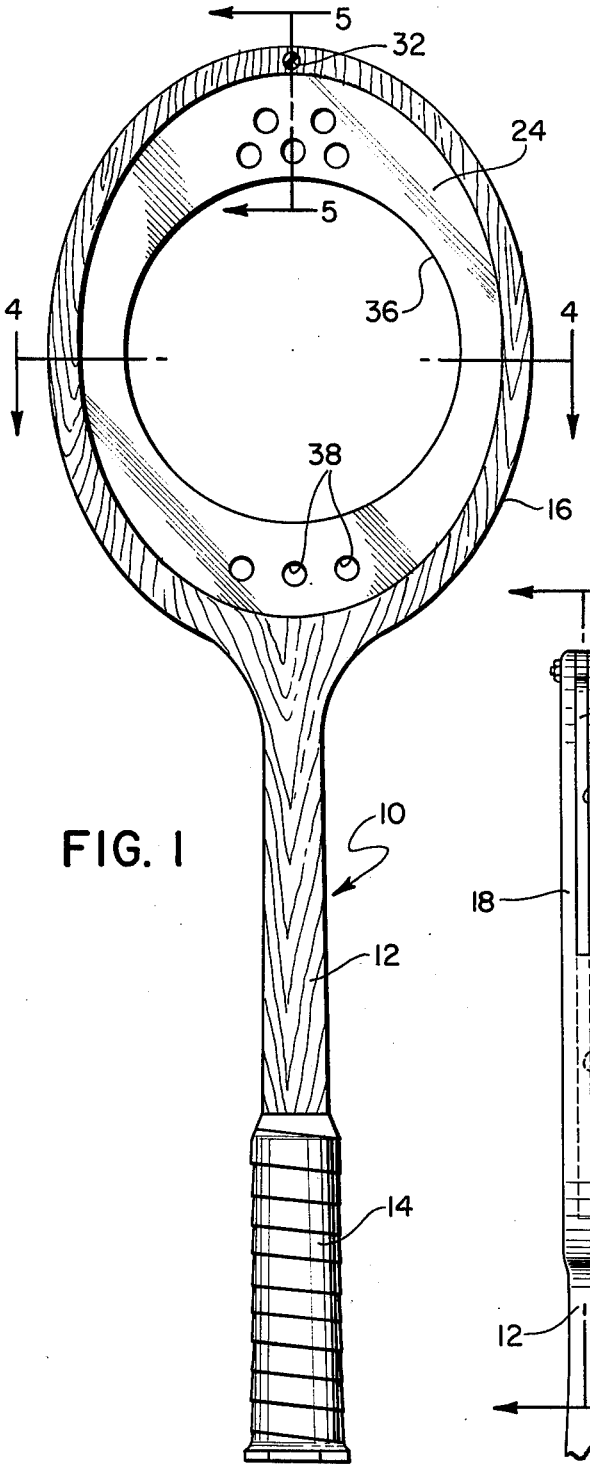
FIG. 1 is a front elevational view showing a practice tennis racket constructed in accordance with the present invention.
Figure 2:
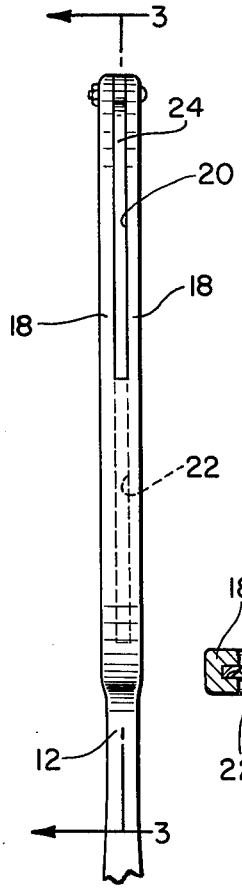
FIG. 2 is a partial side elevational view thereof.
Figure 3:
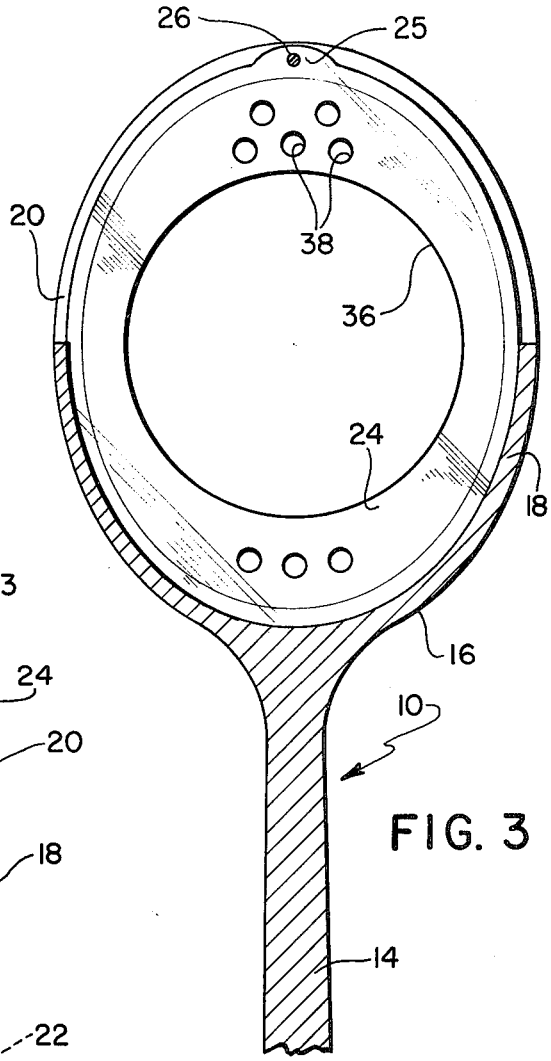
FIG. 3 is a partial sectional view taken along the line 3—3 of FIG. 2.
Figure 4:
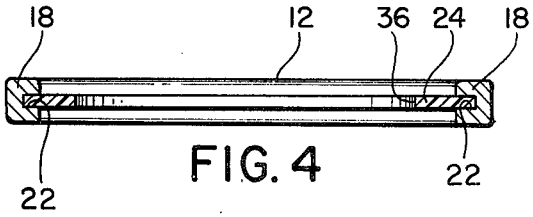
FIG. 4 is an end sectional view taken along the line 4—4 of FIG. 1.
Figure 5:
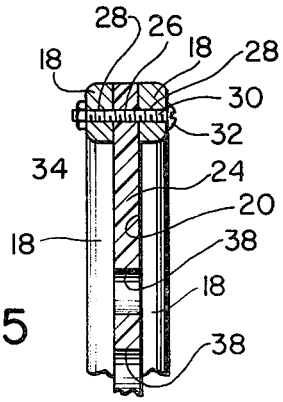
FIG. 5 is a partial side sectional view taken along the line 5—5 of FIG. 1.
Figure 6:
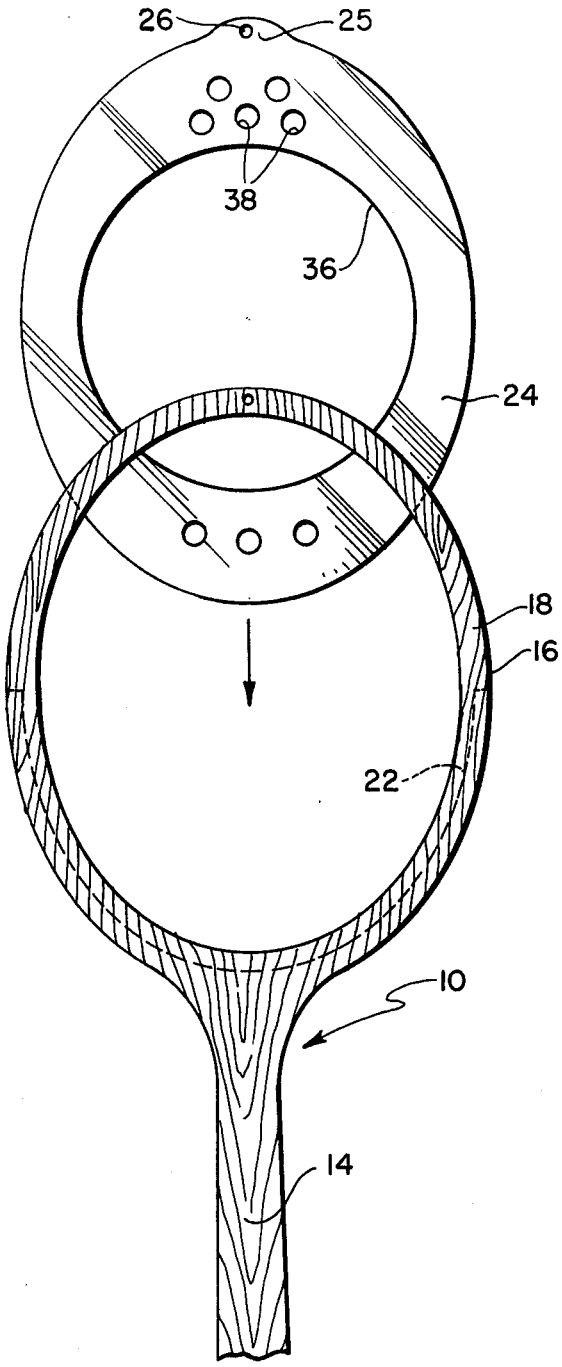
FIG. 6 is a partial front elevational view similar to FIG. 1 but wherein frame and the insert therefor are shown in partially exploded disposition to one another.

The practice racket 10 of the present invention resembles a racket such as that used for tennis. The racket 10 includes a handle 12 including a grip portion 14 disposed at one end thereof and a peripheral frame 16 disposed at the other end thereof. The constructional materials used for this racket may be those used in conventional rackets, i.e. laminated wood, aluminum and other materials. The overall shape, size and configuration of the racket including that area encompassed by the frame 16 is comparative to a standard tennis racket. There are, however, no strings utilized to define the standard impact area of a conventional racket and furthermore the frame 16 is made up of frame portions 18 of similar configuration and in opposed parallel disposition to one another so as to form an open slot 20 extending approximately half way along the longitudinal extent of the frame 16 and a closed groove 22 extending the remaining portion.

An insert 24 formed of a relatively stiff, essentially transparent material sheet is adapted for disposition between the frame portions 18 within the confines of the above-indicated slot and groove. The peripheral extent of the insert 24 is generally similar to that of the frame 16 and is provided at the top end thereof with an extension 25 through which an alignment opening 26 is disposed. Opening 26 is adapted for alignment with similar openings 28 disposed through the frame sections 18. The openings 28 and 26, when aligned with each other, are adapted to receive fastening means in the form of a threaded post 30 having a head 32 and a nut 34 by which the frame portions 18 may be resiliently clamped into engagement with the insert 24, thus securely assembling the insert 24 to the frame 16. Should it become desirable to remove the insert 24, such as for substitution of a different insert, as hereinafter discussed, the fastening means 30, 32 may be easily removed, and the insert slidably retracted from the frame. Obviously, other suitable forms of fasteners could be used to retain the insert 24 in secure assembled relation with frame 16.

The insert 24 is provided with a centrally disposed opening 36 of an extent materially less than that area defined by the peripheral frame 16 and materially larger than a game ball such that a game ball may pass entirely therethrough upon practice stroking of the racket 10. Accordingly, the frame 16 defines an area corresponding to the impact area of a conventionally strung racket frame wherein the opening 36 within the insert 24 defines a second area which is equivalent to the preferred impact area, i.e. "sweet spot", of a conventionally strung racket.

Those areas of the insert 24 surrounding the opening 36 and within the area defined by the frame 16 represent that portion of the total impact area of a conventional racket which is not as desirable for impact with a game ball as is the central area or "sweet spot". In addition, the insert 24 is provided with a plurality of secondary openings 38 so as to reduce air resistance to the racket as it is swung in practice. Also, the material from which the insert 24 is formed may be chosen for its weight characteristics such that the total weight of the practice racket 10 may be similar to that of a conventional racket and in this regard one-eighth inch Plexiglass material may be utilized. Other suitable materials include polyolefin plastic materials including polypropylene, polyethylene and copolymers thereof.

Figure 7:
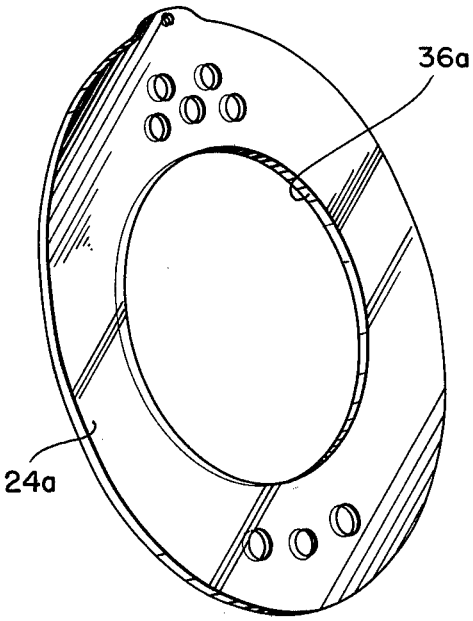
FIG. 7 is a perspective view of an insert similar to that shown in FIG. 6, but wherein the central opening thereof is of a materially smaller extent.

In practice, the racket 10 is swung at a game ball in the normal manner as if actually playing the game so as to attempt contact with the ball at the preferred central portion of the frame 16. Should the stroke and the relative positioning of the racket head and the ball accomplish such preferred stroke, the ball will pass entirely through the opening 36 without contacting the insert 24. In this manner then, a dramatic exhibition of the accomplishment of the preferred stroke is brought about. Also, as best shown in FIG. 7, the insert may take a modified form as shown by reference numeral **24*a*. In such form, the insert 24*a* is of the same overall configuration as insert 24, but includes an opening 36*a* of a smaller dimension. In this mannter then, various inserts having progressively smaller openings may be substituted for the original insert 24 and thus make the accomplishment of the preferred stroke increasingly difficult. Thus, the inserts 24, 24*a*** may be slidably removed wherever desired, whereupon as the player becomes more proficient, he or she may successfully practice with the insert having the smallest opening provided therein. Obviously several such modified inserts each having progressively smaller "sweet spot" openings may be utilized.

While there is shown and described herein certain specific structure embodying the invention, it will be manifest to those skilled in the art that various modifications and rearrangements of the parts may be made without department from the spirit and scope of the underlying inventive concept and that the same is not limited to the particular forms herein shown and described except insofar as indicated by the scope of the appended claims.

What is claimed is:

1. A practice racket for tennis and the like in which proper execution of a preferred practice stroke against a game ball by a player is performed comprising, a handle portion adapted to be grasped by the player to execute a stroke, and a peripheral frame, said frame being free of strings and being attached to said handle and defining an area corresponding to the strung impact area of a conventional tennis racket wherein a ball is normally struck in regular game play, an insert having a substantially planar area and being engaged by and positioned within said frame and being substantially parallel to the plane of said frame, said insert defining a ball impact area and a ball passage area for said practice racket, said ball passage area being defined by an opening positioned generally centrally of said insert whereby a game ball may pass entirely therethrough upon proper execution of said practice stroke, said opening being completely unobstructed.

2. The practice racket of claim 1, wherein said insert is replaceable and there are a plurality of said inserts, each said insert having a progressively smaller ball passage area so as to render proper execution of a preferred practice stroke increasingly difficult.

3. The practice racket of claim 1, said frame including opposed spaced apart and parallel frame portions, said insert being removably positioned between said frame portions.

4. The practice racket of claim 3, said frame portions and said insert having aligned openings therethrough and fastening means removably inserted through said aligned openings for securing said insert within said frame.

5. The practice racket of claim 3, said insert being an essentially transparent material sheet having its peripheral edge disposed between said frame portions.

6. The practice racket of claim 5, said ball impact area has a plurality of secondary openings so as to decrease the wind resistance of said practice racket when executing a practice stroke.

7. The practice racket of claim 5, wherein said insert is replaceable and there are a plurality of said inserts, each said insert having a progressively smaller ball passage area so as to render proper execution of a preferred practice stroke increasingly difficult.

8. The practice racket of claim 7, said frame portions being integrally joined to each other along a portion of said frame and in the area where said handle is attached to said frame, said frame portions further forming a slot therebetween for said removably positioning of said insert.

9. The practice racket of claim 5, said insert and said frame being of essentially coextensive elliptical configuration, said aligned openings being disposed at that end of said frame and insert and being disposed away from the connection between said handle and said frame.

10. The practice racket of claim 1, said ball impact area has a plurality of secondary openings so as to decrease the wind resistance of said practice racket when executing a practice stroke.

* * * * *